US010092807B1

(12) United States Patent
Chaplin et al.

(10) Patent No.: US 10,092,807 B1
(45) Date of Patent: Oct. 9, 2018

(54) SHOOTING PRO SYSTEM

(71) Applicants: Willie Edward Chaplin, Patchogue, NY (US); Regina Lynne Chaplin, Patchogue, NY (US)

(72) Inventors: Willie Edward Chaplin, Patchogue, NY (US); Regina Lynne Chaplin, Patchogue, NY (US)

( * ) Notice: Subject to any disclaimer, the term of this patent is extended or adjusted under 35 U.S.C. 154(b) by 0 days.

(21) Appl. No.: 15/016,733

(22) Filed: Feb. 5, 2016

Related U.S. Application Data

(60) Provisional application No. 62/112,328, filed on Feb. 5, 2015.

(51) Int. Cl.
*A63B 69/00* (2006.01)

(52) U.S. Cl.
CPC ..... *A63B 69/0071* (2013.01)

(58) Field of Classification Search
CPC ..... A63B 69/00; A63B 69/34
USPC ..... 473/447, 406, 446, 438, 422
See application file for complete search history.

(56) References Cited

U.S. PATENT DOCUMENTS 5,527,185 A * 6/1996 Davis ..... A63B 69/34 434/247
5,688,197 A * 11/1997 Peeters ..... A63B 69/0026 473/446
5,816,952 A 10/1998 Blevins
6,159,111 A * 12/2000 Purcell ..... A63B 69/0071 248/127
6,413,196 B1 * 7/2002 Crowson ..... A63B 21/153 273/317
6,544,132 B1 4/2003 Tvedt
8,113,969 B1 * 2/2012 Martin ..... A63B 69/0071 473/422
2004/0224784 A1 * 11/2004 Morelli ..... A63B 69/3685 473/229
2005/0192126 A1 * 9/2005 Remaklus ..... A63B 63/08 473/447
2007/0060420 A1 * 3/2007 Bradford ..... A63B 63/083 473/447
2009/0209369 A1 * 8/2009 Smith ..... A63B 57/207 473/406

* cited by examiner

*Primary Examiner* — Gene Kim
*Assistant Examiner* — Christopher Glenn
(74) *Attorney, Agent, or Firm* — Alfred M. Walker

(57) ABSTRACT

A basketball shooting training device includes a height adjustable stand and a reel member. The height adjustable stand includes a base member and an elongated adjustable post member. The base member is adapted to be placed on a basketball court and remain in a stable position. The post member is attached at a proximal end to the base member and extends vertically therefrom. The reel member includes a housing adapted to be removable connected to a distal end of the post member; a retractable winding mechanism attached within said housing; and an elongated cord member attached to said winding mechanism and adapted to be extended from said housing and releasably attached to a rim of a basketball goal.

14 Claims, 5 Drawing Sheets

SHOOTING PRO SYSTEM

CROSS-REFERENCE TO RELATED APPLICATION

The present application is related to and claims priority from prior provisional application Ser. No. 62/112,328, filed Feb. 5, 2015 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of sports training aids and more specifically relates to a basketball shooting training device designed to help basketball players to develop their accuracy in shooting.

2. Description of the Related Art

Basketball is a sport played by two teams of five players on a rectangular court. The objective is to shoot a ball through a hoop 18 inches (46 cm) in diameter and 10 feet (3.048 m) high mounted to a backboard at each end. Basketball is one of the world's most popular and widely viewed sports. For example, that nearly 7 million children (ages 6 to 18) play basketball. Whether they play on the school team, in a youth league, in school intramurals, or in the driveway or backyard half-court, one skill all these kids need to develop is shooting—and there is very little other than trial-and-error practice to help them along.

Various attempts have been made to solve problems found in sports training aids art. Among these are found in: U.S. Pat. No. 6,159,111 to Boyd C. Purcell; U.S. Pat. No. 6,544,132 to Ryan Tvedt; U.S. Pat. No. 5,816,952 to Mark William Blevins. This prior art is representative of sports training aids for improving basketball shooting accuracy. None of the above inventions and patents, taken either singly or in combination, is seen to describe the invention as claimed.

Ideally, a basketball shooting training device may be user-friendly and safe in-use and, yet may operate reliably and be manufactured at a modest expense. Thus, a need exists for a basketball shooting training device designed to help basketball players to develop their accuracy in shooting for solo driveway practice and for use in schools and recreational facilities to provide a user a line and distance of their shot thereby providing a roadmap to the hoop and to avoid the above-mentioned problems.

BRIEF SUMMARY OF THE INVENTION

In view of the foregoing disadvantages inherent in the known sports training aids art, the present invention provides a basketball shooting training device (entitled The Shooting Pro System). The general purpose of the present invention, which will be described subsequently in greater detail is to provide a basketball shooting training device to help basketball players to develop accuracy in shooting for solo driveway practice and for use in schools and recreational facilities to provide a user a line and distance of their shot thereby providing a roadmap to the hoop.

A basketball shooting training device comprising: a height adjustable stand and a reel member. The height adjustable stand includes a base member and an elongated adjustable post member. The base member is adapted to be placed on a basketball court and remain in a stable position. The post member is attached at a proximal end to the base member and extends vertically therefrom. The reel member includes a housing adapted to be removable connected to a distal end of the post member; a retractable winding mechanism attached within the housing; and an elongated cord member attached to the winding mechanism and adapted to be extended from the housing and releasably attached to a rim of a basketball goal. The material of the basketball shooting training device is chosen from a list of materials consisting of water, sand, and concrete.

The base member is formed as a foldable tripod. The base member and the post member are formed from a material chosen from a list of materials consisting of aluminum, steel, and plastic.

The base member further includes at least one suction cup attached to a bottom surface thereof adapted to hold the base in place upon the basketball court and remain in a stable position. The base member further includes at least one wheel member attached to a bottom surface thereof adapted allow the basketball shooting training device to be moved between locations on the basketball court more easily. The base member includes a hollow interior, an opening thereto, and a material adapted to be placed within the hollow interior used to provide mass and weight to the base member.

The elongated adjustable post member is formed from two telescoping post sections releasably connected via an adjustable connector member. The connector member is chosen from a group of connector members consisting of a tensioning collar clamp, a wing nut, a butterfly nut, and a set screw. The adjustable post member is extendable between the heights of 4 feet and 7 feet.

The retractable winding mechanism includes a spring member adapted to wind the winding mechanism and retract said cord member when released from said rim of said basketball goal. The cord member is formed from a braided nylon material. The basketball shooting training device further comprising a handle member attached to the housing of the reel member to thereby aid in extending and retracting the adjustable post member.

The basketball shooting training device further comprising a clip member attached to a distal end of the cord member, wherein the clip member is adapted to be removably attached to the rim of a basketball goal. The clip member is formed having a U-shape adapted to more easily securely and removably attach the distal end of said cord member to the rim of a basketball goal.

The present invention holds significant improvements and serves as a basketball shooting training device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, basketball shooting training device (entitled The Shooting Pro System), constructed and operative according to the teachings of the present invention.

The various embodiments of the present invention will hereinafter be described in conjunction with the appended drawings, wherein like designations denote like elements.

DETAILED DESCRIPTION

Figure 1:
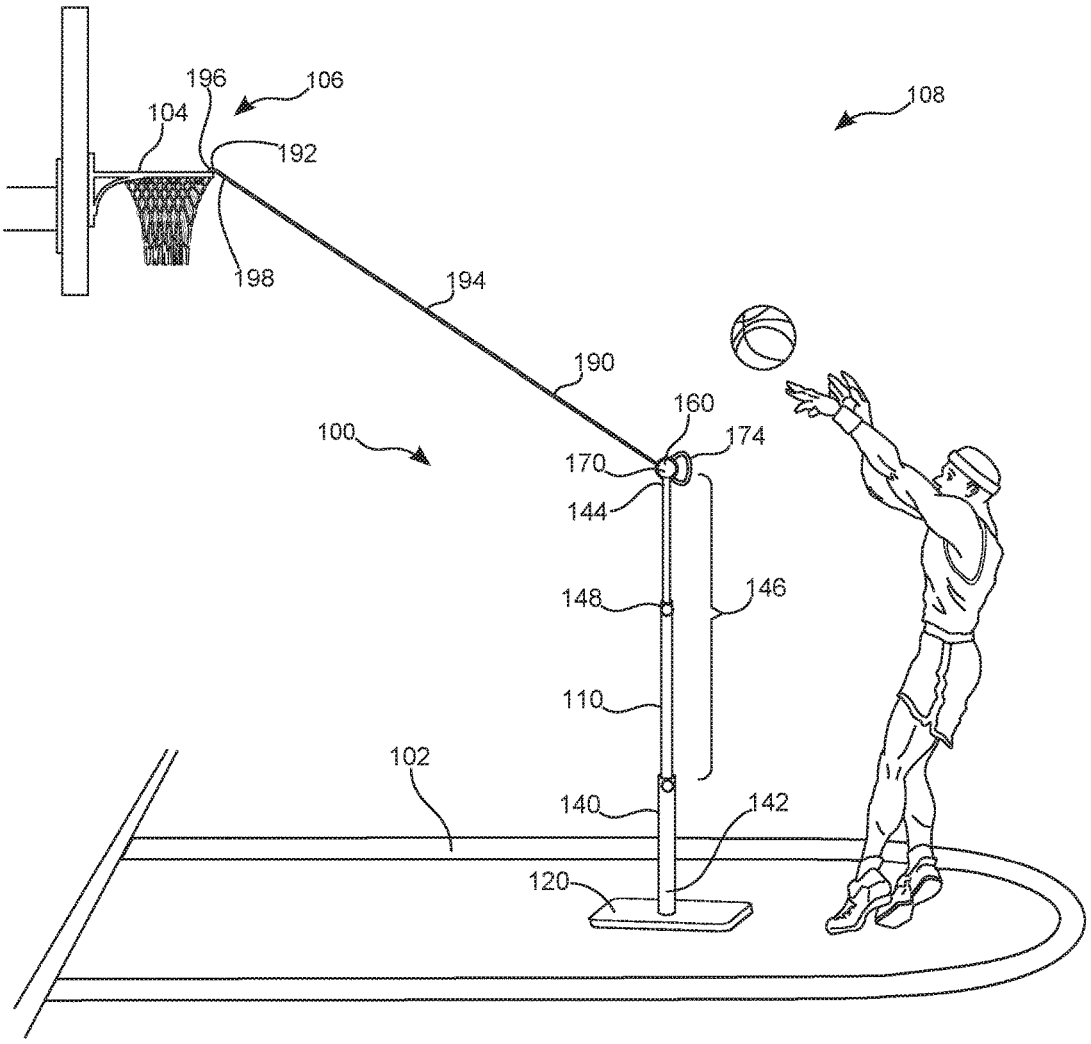
FIG. 1 shows a perspective view illustrating a basketball shooting training device in an 'in-use' condition according to an embodiment of the present invention.

As discussed above, embodiments of the present invention relate to a sports training aids and more particularly to basketball shooting training device (The Shooting Pro System) to provide a basketball shooting training device to help basketball players to develop accuracy in shooting for solo driveway practice and for use in schools and recreational facilities to provide a user a line and distance of their shot thereby providing a roadmap to the hoop.

Generally speaking, the Shooting Pro System comprising a novel product offering consumers a practical solution to the aforementioned challenges. As the name implies, the Shooting Pro comprises a specially designed straightforward, non-electronic training aid designed for use in developing one's basketball-shooting skills: a system in which a retractable cord extends from a height-adjustable stand to the hoop, thus giving the shooter both the line of his or her shot, and the distance—the two variables which, along with the loft, determine whether a shot is a score or a miss.

The Shooting Pro System consists of a height-adjustable stand and a spring-loaded, retractable cord. The Shooting Pro System stand would be fabricated in either round aluminum-alloy tubing or in a tough and durable, molded thermoplastic. The stand is designed with a broad, stable base and a tube-within-tube configuration, permitting heights from a minimum of 4 feet to a maximum of 7 feet. The inner tube, which telescopes from within an outer tube, may be secured at any height by means of a tensioning collar-clamp and a wing-nut or butterfly nut.

The base of the stand would be equipped with one or more rubber or silicon suction-cups, a slide-and-lock tripod such as those found in portable light-stands, or a hollow disk with a fill-spout and cap for filling with water or sand; or simply a flat circular, collar-style base of sufficient weight and diameter to hold the stand securely upright. At the top of the inner, telescoping tube is a detachable, molded plastic reel, spring-loaded and wound with a light braided nylon cord, at the distal end of which is a hook or clip. The clip serves to secure the end of the cord to the rim of the basketball goal.

The player would take the Shooting Pro to the player's intended position on the court, extend the stand to the player's height and lock it; and pull the clip and cord out from the spring-loaded reel and clip the cord to the front of the goal's rim. The player would now stand to one side of the Shooting Pro, and practice his or her shot. With variables clearly demarcated by the Shooting Pro, the player will be able to align his or her shot more easily, and to gauge the distance. Thus, with the Shooting Pro at his or her side, the player will have a reliable guide for the line and distance of the shot, and be free to work on the last variable, the loft of the shot.

Referring now to the drawings by numerals of reference there is shown in FIGS. 1-4 perspective views illustrating basketball shooting training device 100 according to an embodiment of the present invention.

Basketball shooting training device 100 comprising: height adjustable stand 110 and reel member 160. Height adjustable stand 110 includes base member 120 and elongated adjustable post member 140. Base member 120 is adapted to be placed on basketball court 102 and remain in a stable position as shown in in-use condition 108 of FIG. 1. Post member 140 is attached at proximal end 142 to base member 120 and extends vertically therefrom. Reel member 160 includes housing 170 adapted to be removable connected to distal end 144 of post member 140; retractable winding mechanism 180 attached within housing 170; and elongated cord member 190 attached to winding mechanism 180 and adapted to be extended from housing 170 and releasably attached to rim 104 of basketball goal 106.

Base member 120 is formed as foldable tripod 124. Base member 120 and post member 140 are formed from a material chosen from a list of materials consisting of aluminum, steel, and plastic.

Figure 4:
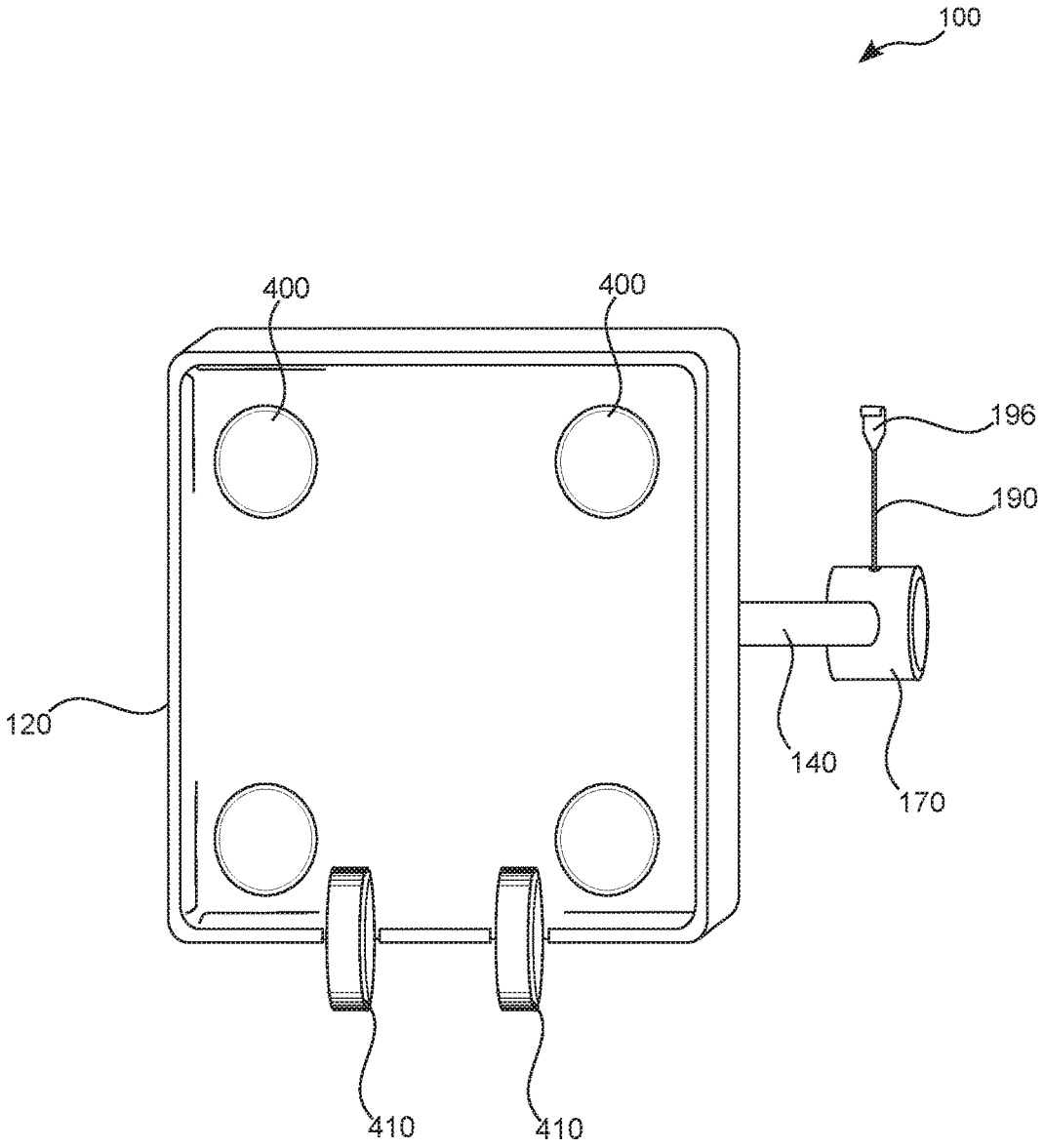
FIG. 4 is a perspective view illustrating the basketball shooting training device according to an embodiment of the present invention.
Figure 5:
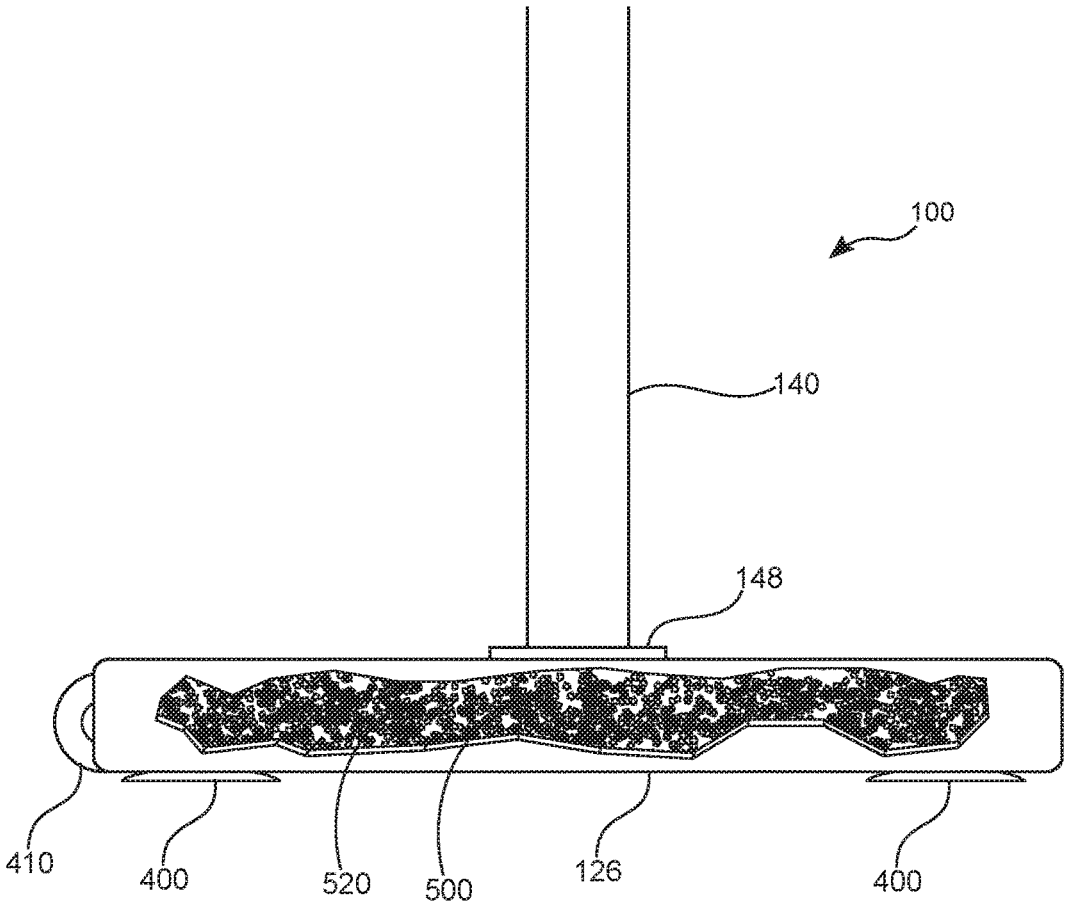
FIG. 5 is a perspective view illustrating a base member includes a hollow interior and an opening thereto of the basketball shooting training device according to an embodiment of the present invention of FIGS. 1-4.

Base member 120 further includes at least one suction cup 400 attached to bottom surface 126 thereof adapted to hold base member 120 in place upon basketball court 102 and remain in a stable position as shown in FIG. 4. Base member 120 further includes at least one wheel member 410 attached to bottom surface 126 thereof adapted allow basketball shooting training device 100 to be moved between locations on basketball court 102 more easily. Base member 120 includes hollow interior 500, opening thereto 510, and material 520 adapted to be placed within hollow interior 500 used to provide mass and weight to base member 120 as shown in FIG. 5. Material 520 of basketball shooting training device 100 is chosen from a list of materials consisting of water, sand, and concrete.

Figure 3:
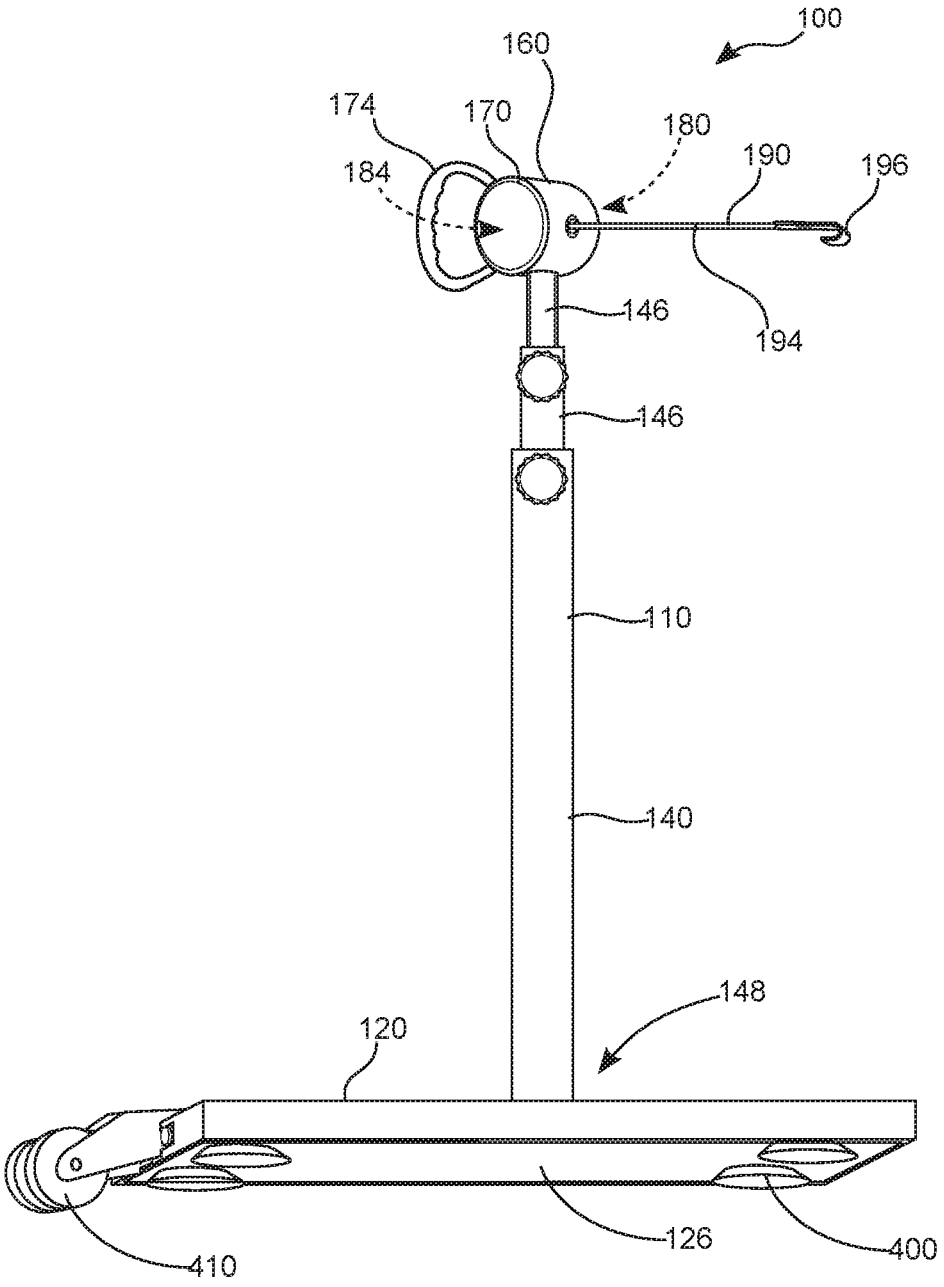
FIG. 3 is another perspective view illustrating basketball shooting training device according to an embodiment of the present invention

Elongated adjustable post member 140 is formed from two telescoping post sections 146 releasably connected via adjustable connector member 148 as shown in FIG. 3. When elongated adjustable post member 140 is formed from two telescoping post sections 146, with this elongated adjustable post member 140 stand for younger/shorter children/players. In an additional embodiment, when elongated adjustable post member 140 may be formed from three telescoping post sections 146, with this elongated adjustable post member 140 stand may be suitably be used by older/taller high school/college/professional players. It should be noted that Connector member 148 is chosen from a group of connector members 148 consisting of a tensioning collar clamp, a wing nut, a butterfly nut, and a set screw. Adjustable post member 140 is extendable between the heights of 4 feet and 7 feet.

Figure 2:
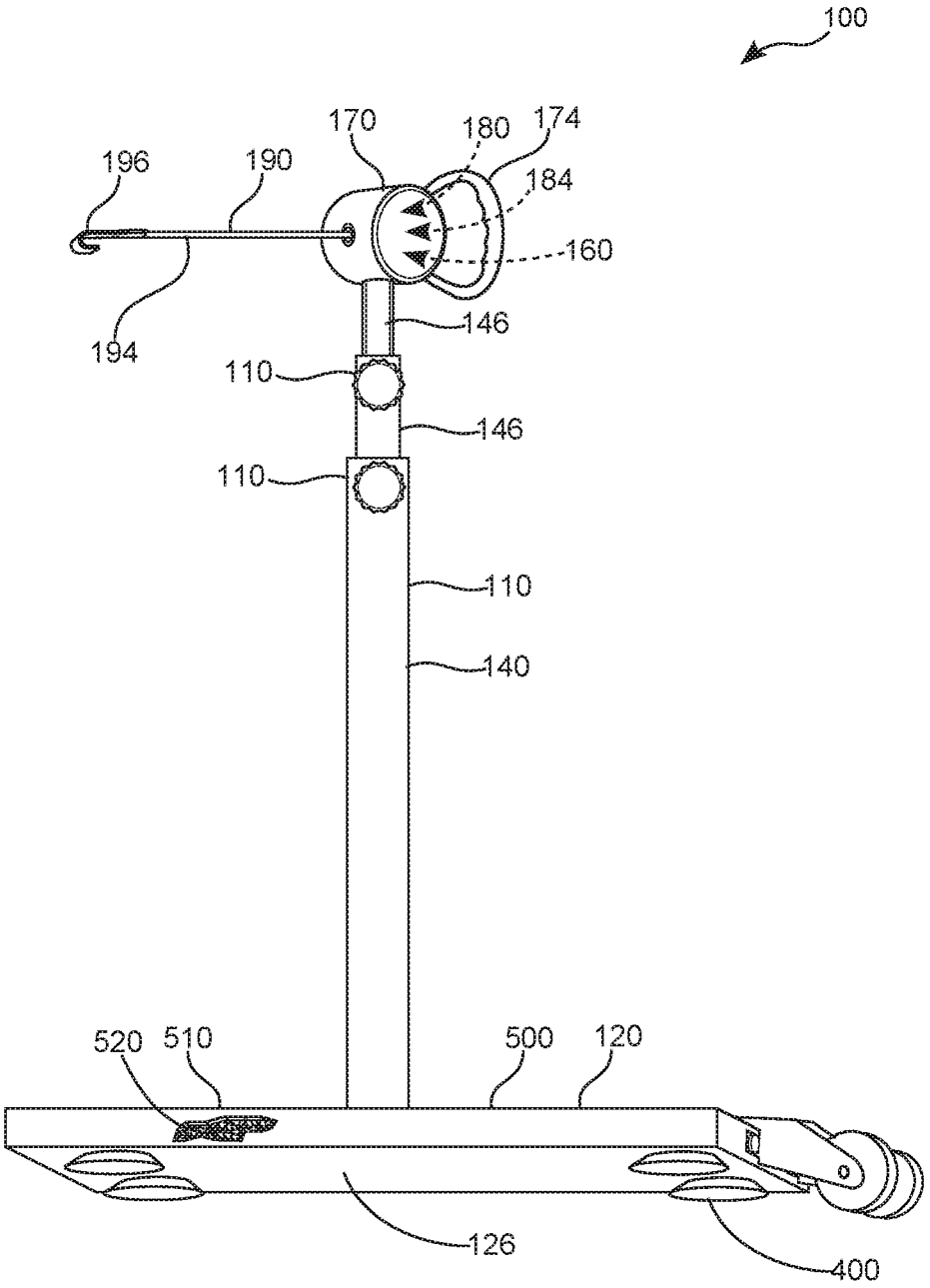
FIG. 2 shows a perspective view illustrating basketball shooting training device according to an embodiment of the present invention.

Retractable winding mechanism 180 includes spring member 184 adapted to wind winding mechanism 180 and retract cord member 190 when released from rim 104 of basketball goal 106 as shown in FIG. 2. Cord member 190 is formed from braided nylon material 194.

Basketball shooting training device 100 further comprising handle member 174 attached to housing 170 of reel member 160 to thereby aid in extending and retracting adjustable post member 140.

Basketball shooting training device 100 further comprising clip member 196 attached to distal end 198 of cord member 190, wherein clip member 190 is adapted to be removably attached to rim 104 of basketball goal 106. Clip member 190 is formed having U-shape 192 adapted to more easily securely and removably attach distal end 198 of cord member 190 to rim 104 of basketball goal 106.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A basketball shooting training device comprising: a height adjustable stand including: a base member; wherein said base member is adapted to be placed on a basketball court and remain in a stable position adjacent to a basketball shooting position of a basketball player user; an elongated adjustable post member; wherein said post member is attached at a proximal end to said base member and extends vertically therefrom; and a reel member including: a housing removably connected to a distal end of said post member; a retractable winding mechanism attached within said housing; an elongated cord member attached to and extending from said winding mechanism out through a front of said housing and having a clip mounted on a distal end of said cord member releasably engaged to a rim of a hoop of a basketball goal; a handle member extending out from a rear of said housing to aid in extending and retracting said adjustable post member; an exit opening on one side of said housing for said elongated cord member and a handle member extending from an opposite side of said housing of said reel member to aid in extending and retracting said adjustable post member; means for providing a visual linear line of sight to the basketball player user of an angle and distance from said elongated adjustable post member to the basketball hoop on a backboard comprising said elongated cord member extending in a substantially straight line from said clip attached to the rim of the hoop of the basketball goal toward said distal end of said post member; and said cord member being stationary and under tension produced by said retractable winding mechanism.

2. The basketball shooting training device of claim 1, in which said basketball goal comprises said hoop extending horizontally outward from a backboard.

3. The basketball shooting training device of claim 2, wherein said clip member is formed having a U-shape adapted to more easily securely and removably attach said distal end of said cord member to said rim of said hoop.

4. The basketball shooting training device of claim 2, wherein said elongated adjustable post member is formed from two telescoping post sections releasable connected via an adjustable connector member, said post member having its distal end supporting said housing being positioned at a height substantially at an eye level of the basketball player giving the player an unobstructed view of said rim when shooting.

5. The basketball shooting training device of claim 4, wherein said connector member is chosen from a group of connector members consisting of a tensioning collar clamp, a wing nut, a butterfly nut, and a set screw.

6. The basketball shooting training device of claim 1, wherein said retractable winding mechanism includes a spring member to retract said cord member when released from said rim of said hoop.

7. The basketball shooting training device of claim 1, wherein said base member further includes at least one suction cup attached to a bottom surface thereof adapted to hold said base in place upon said basketball court and remain in a stable position.

8. The basketball shooting training device of claim 1, wherein said base member further includes at least one wheel member attached to a bottom surface thereof adapted to allow said basketball shooting training device to be moved between locations on said basketball court more easily.

9. The basketball shooting training device of claim 1, wherein said base member includes a hollow interior, an opening thereto, and a material adapted to be placed within said hollow interior used to provide mass and weight to said base member.

10. The basketball shooting training device of claim 1, wherein said material is chosen from a list of materials consisting of water, sand, and concrete.

11. The basketball shooting training device of claim 1, wherein said base member is formed as a foldable tripod.

12. The basketball shooting training device of claim 1, wherein said base member and said post member are formed from a material chosen from a list of materials consisting of aluminum, steel, and plastic.

13. The basketball shooting training device of claim 12, wherein said cord member is formed from a braided nylon material.

14. The basketball shooting training device of claim 13, wherein said adjustable post member is extendable between the heights of 4 feet and 7 feet.

* * * * *